US007022052B1

(12) United States Patent
Lai

(10) Patent No.: US 7,022,052 B1
(45) Date of Patent: Apr. 4, 2006

(54) COLLAPSIBLE BOAT ROWING STIMULATOR

(76) Inventor: Fen-Ying Lai, P.O. Box 697, Feng-Yuan City, Taichung Hsien (TW) 420

( * ) Notice: Subject to any disclaimer, the term of this patent is extended or adjusted under 35 U.S.C. 154(b) by 540 days.

(21) Appl. No.: 10/412,310

(22) Filed: Apr. 14, 2003

(51) Int. Cl.
*A63B 69/06* (2006.01)

(52) U.S. Cl. ..... 482/72; 482/73

(58) Field of Classification Search ..... 482/72, 482/73, 53, 126
See application file for complete search history.

(56) References Cited

U.S. PATENT DOCUMENTS 4,756,523 A * 7/1988 Rasmussen ..... 482/73
4,795,147 A * 1/1989 Seal ..... 482/73
D358,855 S * 5/1995 Wang ..... D21/674
5,441,469 A * 8/1995 Chern ..... 482/72
5,658,225 A * 8/1997 Huang ..... 482/72

* cited by examiner

*Primary Examiner*—Stephen K. Cronin
*Assistant Examiner*—Allana Lewin

(57) ABSTRACT

A collapsible boat rowing simulator includes a beam, a T-shaped front support connected to the front end of the beam having a counter and a pair of tread plates disposed thereon, a rear support connected to an underside adjacent rear end of the beam, a middle support secured to a middle underside of the beam, a pair of oars each having a large vertical tube on inner end, a small vertical tube on outer end and a stop rod on a top, a pair of T-shaped tubes each having a vertical portion inserted through the large vertical tubes secured on lower end by a pair of elastic fasteners and a transverse portion rotatably secured to two ends of a crossed rod on the middle support, a pair of arcuate grips each having a vertical axial rod rotatably inserted into the small vertical tubes, a pair of hydraulic cylinders each having one end pivoted a crossed rod of the rear support and the other end pivoted to the elastic fasteners, a seat slidably mounted on the beam having four rollers engaged into a pair of guides in lateral sides of the beam. Both of the oars and the grips are foldable to rely on the beam.

8 Claims, 13 Drawing Sheets

COLLAPSIBLE BOAT ROWING STIMULATOR

BACKGROUND OF THE INVENTION

The present invention relates to sports equipment and more particularly to a collapsible boat rowing simulator which occupies lesser space for transportation.

As we know that the rowing boat is one of the whole body exercise equipment. It can increase strength of the arm, the feet as well as the waist for an athlete. That's why the rowing boat competition is often sponsored. Recently a boat rowing simulator is available in the market. The operation of this boat rowing simulator indoor can achieve the same result as rowing a boat on the water.

FIG. 1 shows a prior art boat rowing simulator 10 which comprises a beam 11, a U-shaped rod 12 connected to the front end of the beam 11, a pair of hydraulic cylinders 13 having one end pivoted to the front portion of the U-shaped rod 12 and the other end pivoted to a pair of oars 14 which have their lower ends pivoted to the rear ends of the U-shaped rod 12, a pair of tread plates 15 together with a counter 16 on the front center and a seat 111 on the rear portion of the beam 11. Due to the wide of the U-shaped rod 12 and height of the oars 14. This type of boat rowing simulator 10 occupies a large space and is inconvenient for transportation.

FIG. 2 shows another prior art boat rowing simulator 20 which comprises a beam 21, a cross rod 22 under the beam 21 a pair tread plate 211 and a counter 212 on the front end of the beam 21, a seat 213 on the rear portion of the beam 21, a pair of links 23 respectively pivoted to two ends of the cross rod 22, a pair of L-shaped oars 24 pivoted to the free ends of the links 23 and a pair of hydraulic cylinders 25 having their front ends pivoted to a top of the links 25 and their rear ends pivoted to the transverse portion of the L-shaped oars 24 respectively. Due to the links 23 stretch outward and the oars 24 extend upward, this type of boat rowing simulator 20 is occupied a large space and is also inconvenient for transportation.

Lately, although a collapsible boat rowing simulator is produced, but it's parts as well as its folding process are rather complicated that is not convenient to the user.

SUMMARY OF THE PRESENT INVENTION

The present invention has a main object to provide a collapsible boat rowing simulator in which the oars and the grips can be folded inward to rely on the beam in order to save the space to put down or to pack for transportation.

Another object of the present invention is to provide a collapsible boat rowing simulator which is convenient to operate to achieve boat rowing result.

Accordingly, the collapsible boat rowing simulator of the present invention comprises generally a beam, a T-shaped front support having an arcuate bar connected to the front end of the beam, a rear support under the rear end of the beam, a middle support under a middle portion of the beam, a seat slidably mounted on the beam, a slant plate projected upward from the front end of the T-shaped support having a cross rod on upper portion for respectively disposing a pair of tread plates and a counter, a pair of hydraulic cylinder have their rear end respectively pivoted to a cross rod of the rear support and their front ends pivoted to a pair of T-shaped tubes, a pair of oars each having a large vertical tube at inner end wrapped on a pair of T-shaped tubes, a stop rod on a top adjacent the large vertical tube and a small vertical tube on the outer end to respectively pivoted to a pair grips. When the oars are pulled rearward, the stop rods are hindered by the T-shaped tubes to prevent the oars from moving farther rearward. The oars and the grips are characterized in that they can be folded together to rely on the beam so as to save the space to put down or to pack for transportation.

The present invention will become more fully understood by reference to the following detailed description thereof when read in conjunction with the attached drawings.

DETAILED DESCRIPTION OF THE PREFERRED EMBODIMENT

Figure 1:
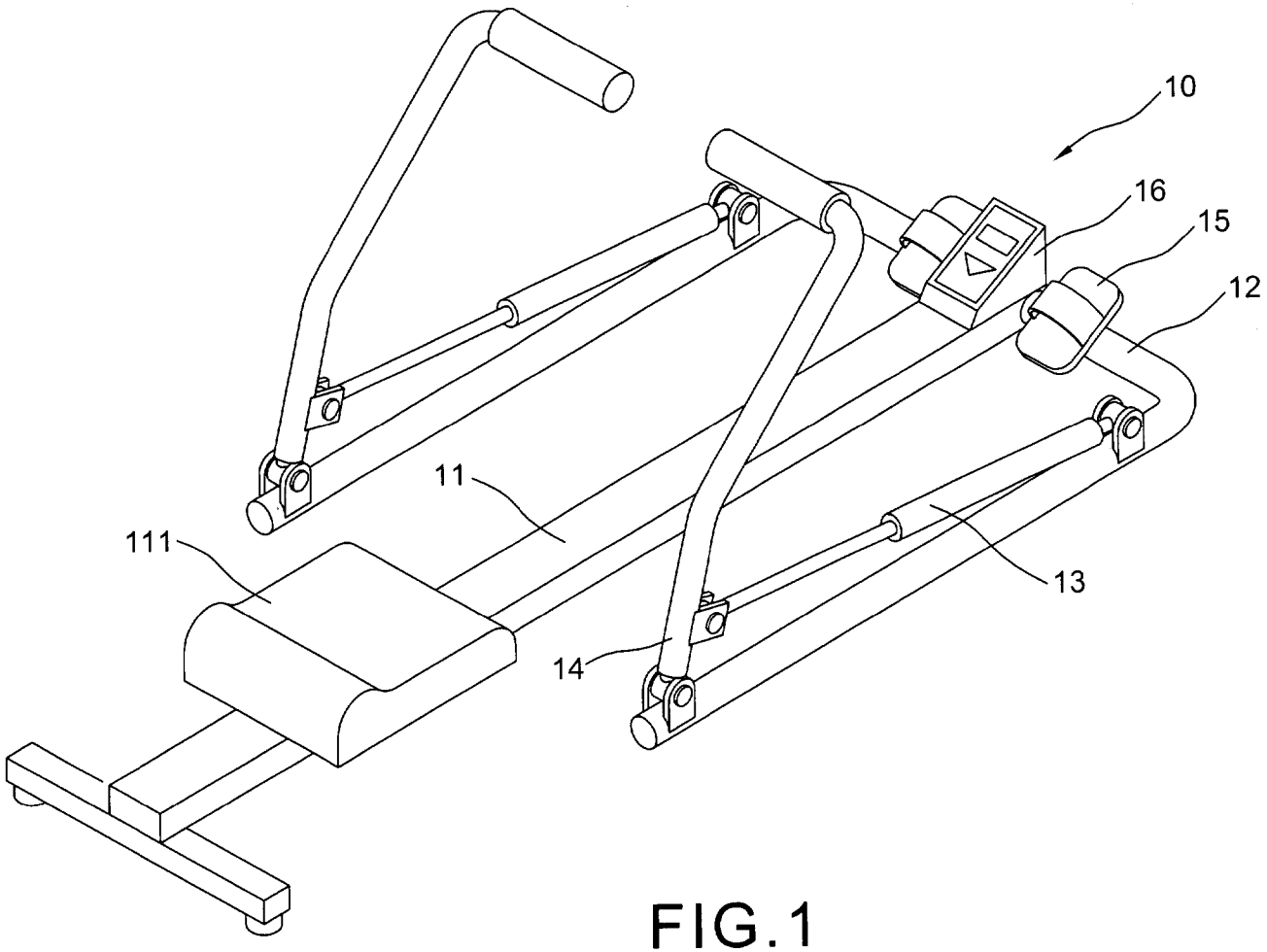
FIG.1 Prior Art
FIG. 1 is a perspective view to show a boat rowing simulator of a prior art.
Figure 2:
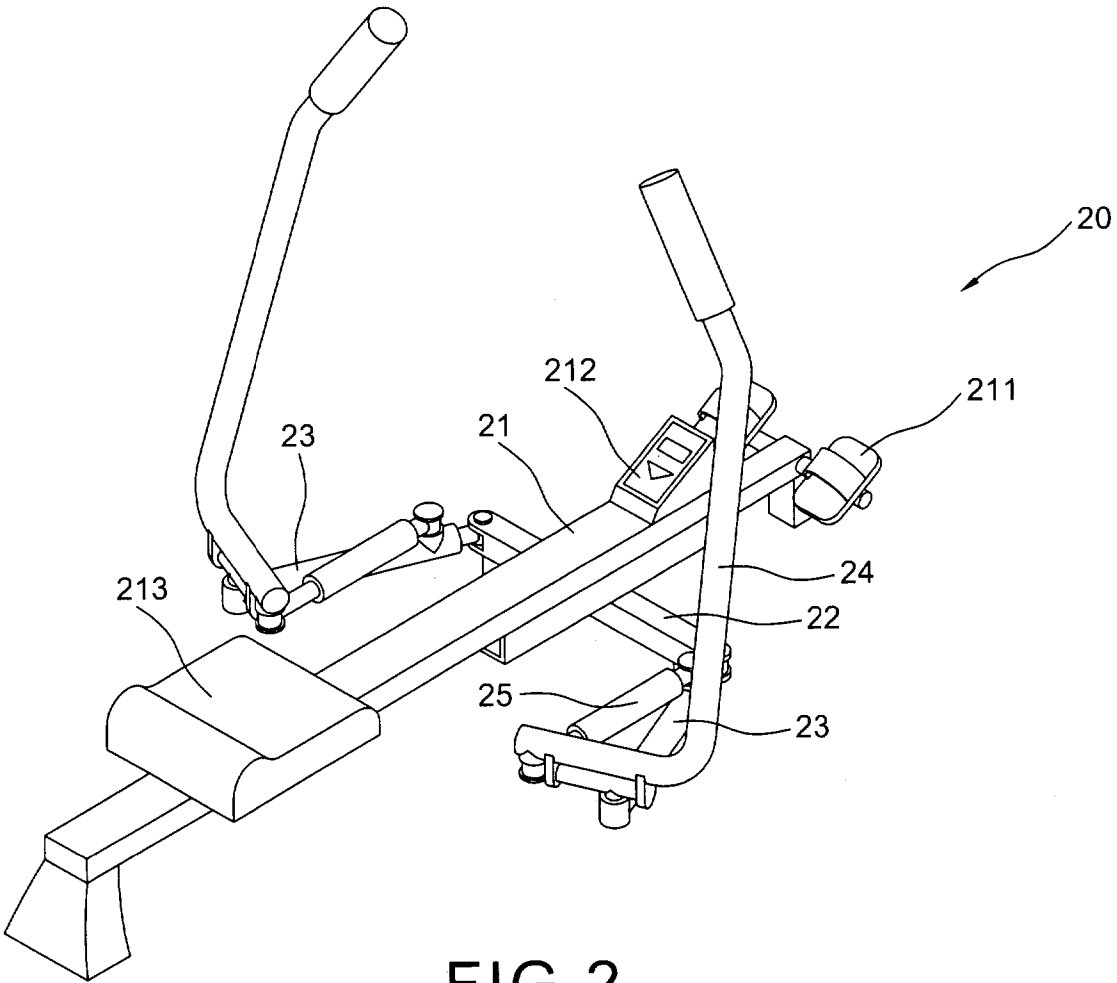
FIG.2 Prior Art
FIG. 2 is a perspective view to show a boat rowing simulator of another prior art.
Figure 3:
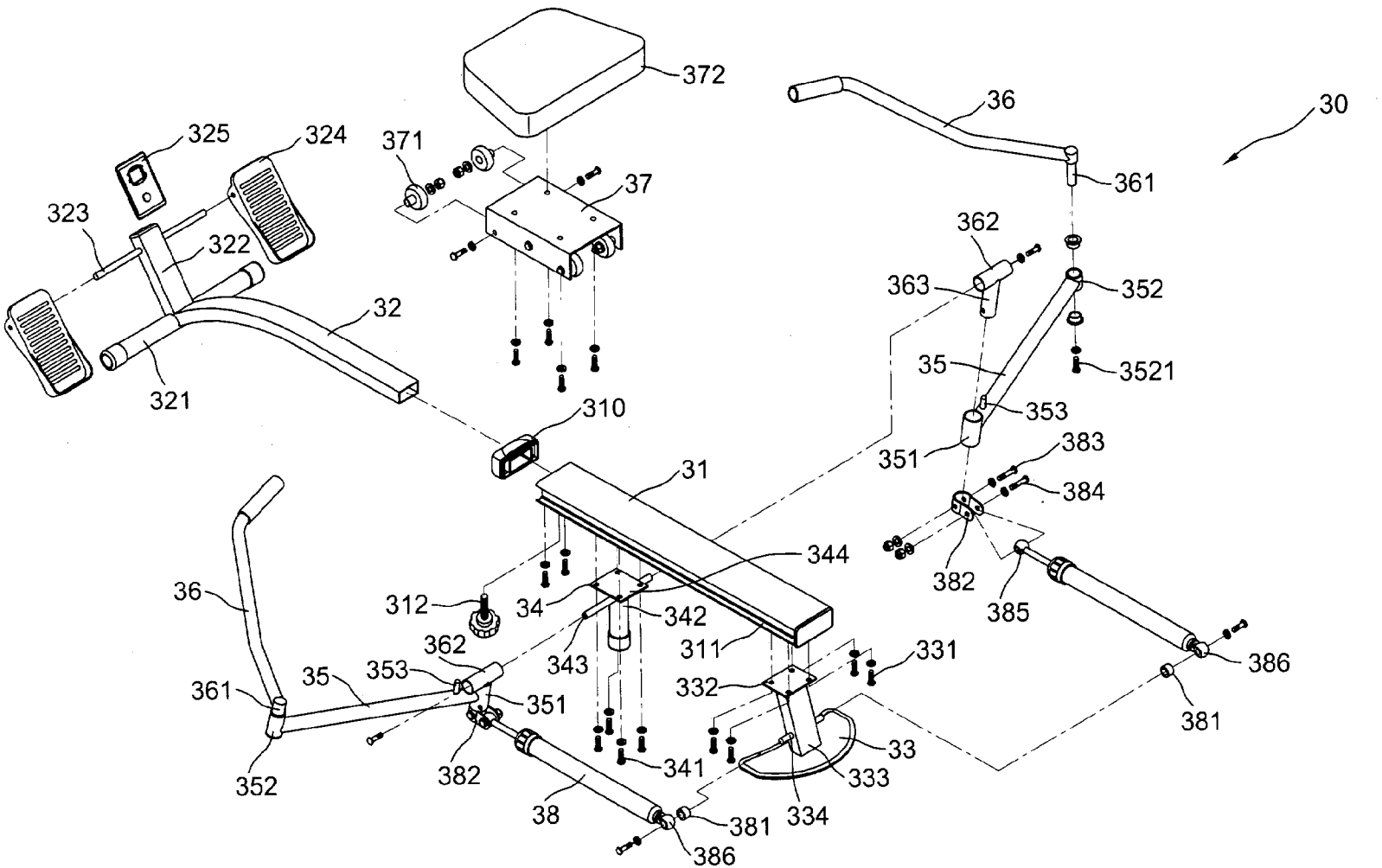
FIG. 3 is an exploded perspective view to show a collapsible boat rowing simulator of the preferred embodiment of the present invention.
Figure 4:
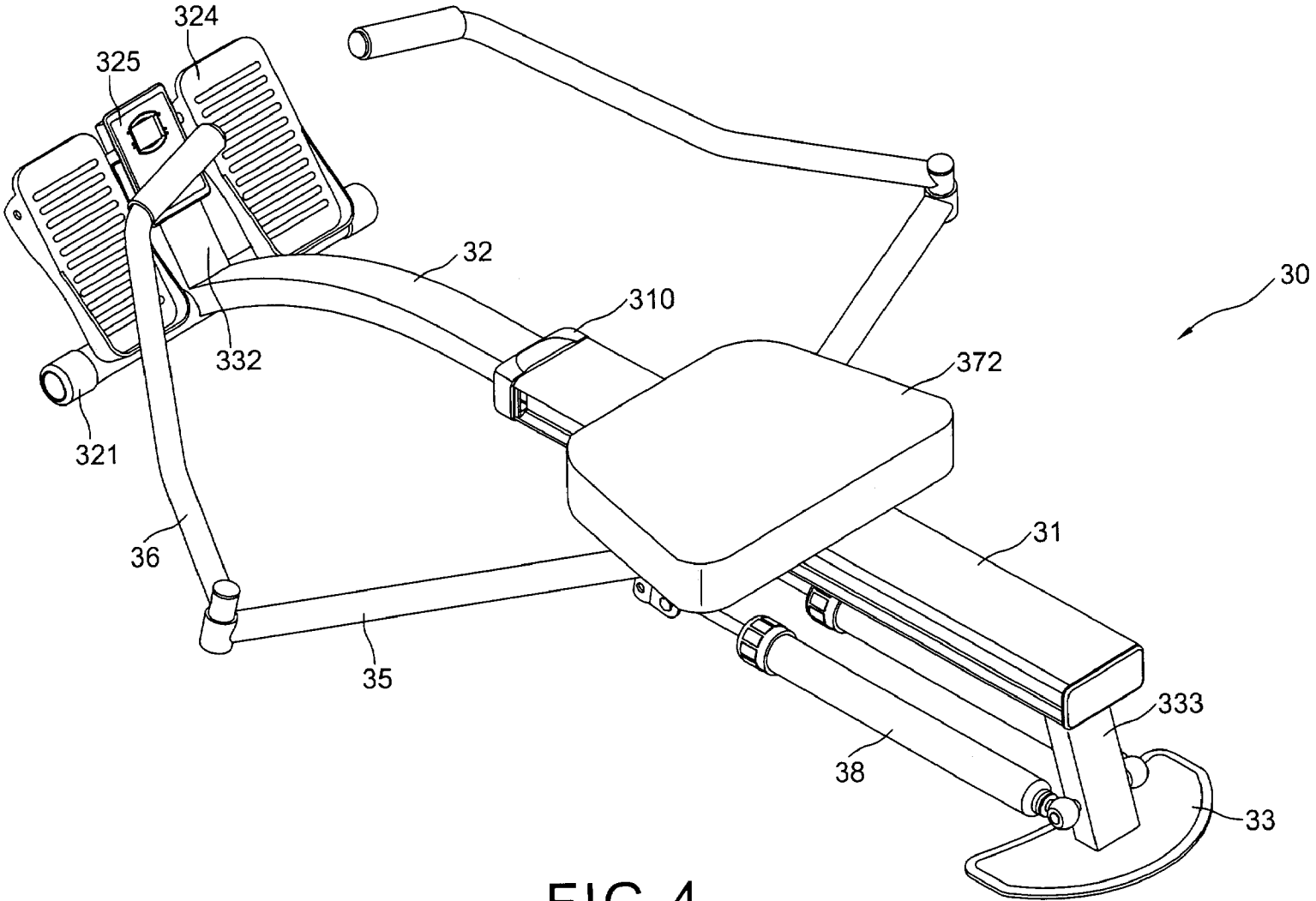
FIG. 4 is a perspective view to show the assembly of FIG. 3.
Figure 5:
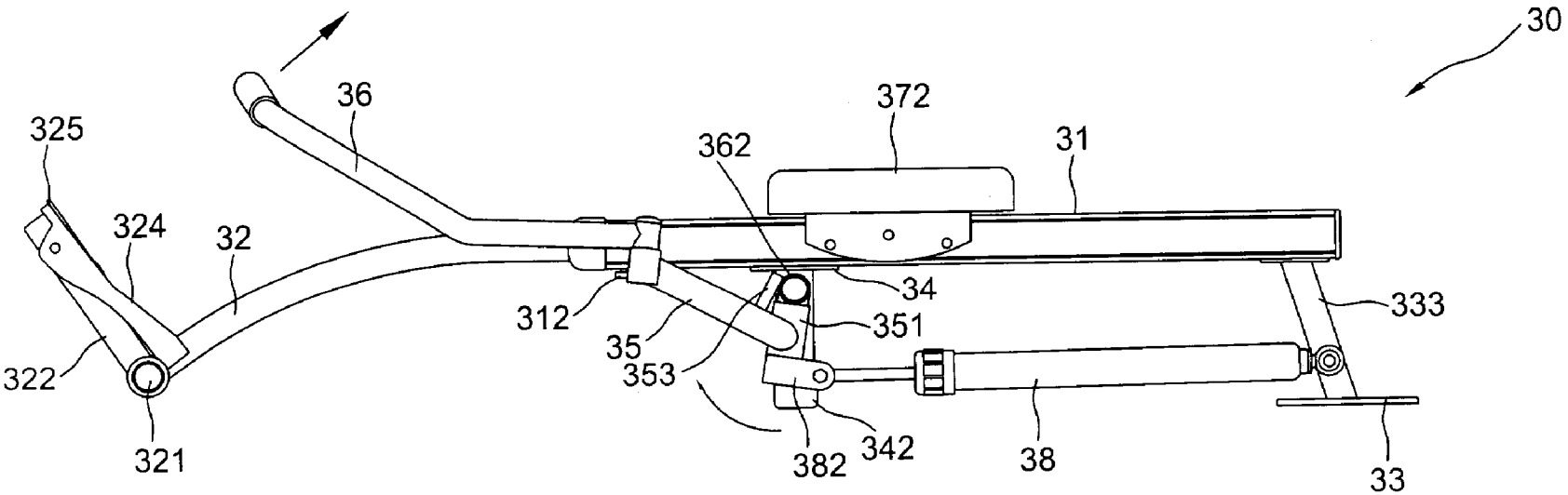
FIG. 5 is a side view to show the operation of the grips of the collapsible boat rowing simulator of the present invention.
Figure 6:
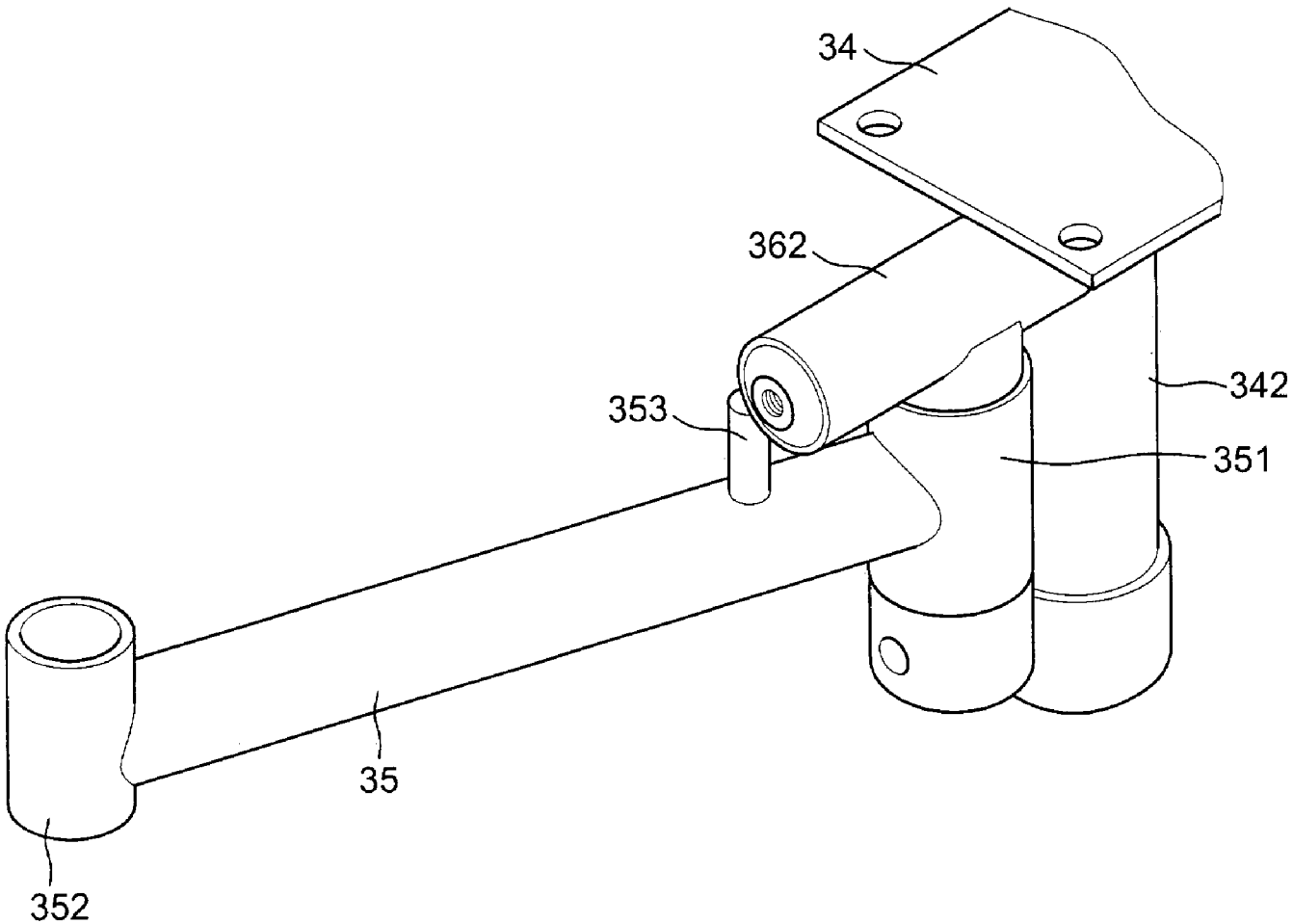
FIG. 6 is a perspective view to show a stop rod hindered by a T-shaped tube.
Figure 7:
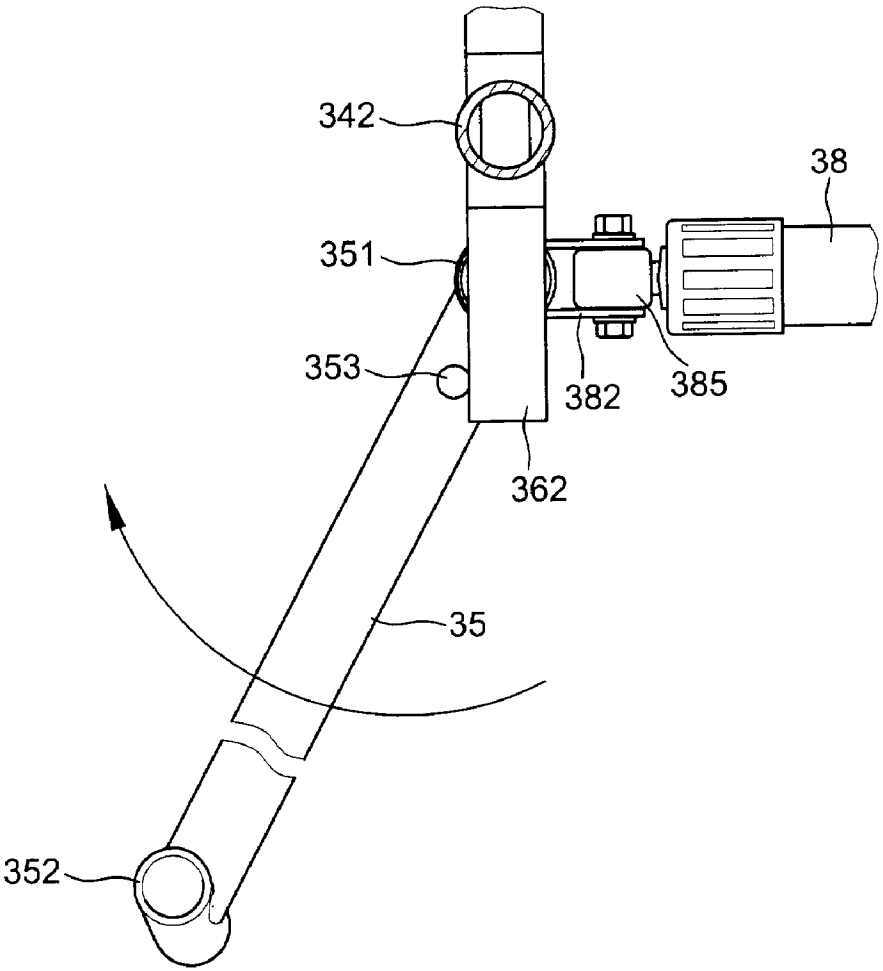
FIG. 7 is a plane view to show the relationship between the stop rod and the T-shaped tube.

With reference to FIGS. 3 and 4 of the drawings, the collapsible boat rowing simulator 30 of the preferred embodiment of the present invention comprises a beam 31 having a guide 311 in each lateral side longitudinally extended along the length thereof, a roughly T-shaped front support 32 having an arcuate portion connected to the front end of beam 31 through a sleeve 310 secured by a shoulder bolt 312 and a pair of screws and a transverse bar 321 standing on the ground, a slant plate 322 centrally projected from the front end of the T-shaped support 32 including a cross rod 323 on an upper portion for respectively disposing a pair tread plates 324, a counter 325 disposed on the slant plate 322, a rear support 33 which has a semi-circular plate standing on the ground, a slant post 333 centrally projected upward from the top of the semi-circular plate, a cross rod 334 on a lower portion of the slant post 333 and a rectangular plate 332 on the top of the slant post 333 for securing the rear support 33 to an underside abutting the rear end of the beam 31 by screws 331, a middle support 34 having vertical post 342, a cross rod 343 on an upper portion of the vertical post 342 and a rectangular plate 344 on the top of the post 342 for securing the middle support 34 to an underside near front end thereof by a plurality of screws 341, a U-shaped slider 37 having four rollers 371 spacedly and rotatably secured to the inner side of a pair of lateral walls slidably engaged within the guides 311 of the beam 31 and a seat 372 secured to the top of the U-shaped slider 37 by a plurality of screws, a pair of oars 35 each having a large vertical tube 351 on inner end, a small vertical tube 352 on outer end and a stop rod 353 projected upward from an upper periphery adjacent the large vertical tube 351, a pair of T-shaped tubes each having a vertical portion 363 inserted through the large vertical tubes 351 of the pair of the oars 35 respectively and secured on lower end by a pair of elastic fasteners 382 and screws 383, a transverse portion 362 respectively and rotatably sleeved on two ends of the cross rod 343 of the middle support 34 secured by screws, a pair of arcuate grips 36 each having a vertical axial rod 361 at inner end rotatably inserted into the small vertical tube 352 of the pair of oars 35 respectively and rotatably secured by screws 3521 with washers engaged therebetween and a pair of hydraulic cylinders 38 each having a rear end 386 respectively pivoted to the two ends of the cross rod 334 of the rear support 33 and secured by screws with a pair of bearings 381 engaged therebetween and a front end respectively pivoted to the open end of the pair of elastic fasteners 382 and secured by screws 384.

Based on aforediscussed structure, in operation, the operator sits on the seat 372 with two feet stopped on the tread plates 324, then grasps the upper end of the pair of the grips 36 and pulls the grips together with the oars 35 rearward. Meanwhile, the T-shaped tubes begin to rotate to drag the pair of the hydraulic cylinders 38 forward to create a resistant force to force the operator using appropriate strength on the arms just like to row a boat on the water (as shown in FIGS. 4, 5, 6 and 7). Due to the stop rods 353 hindered by the T-shaped tubes to limit the grips 36 and the oars 35 from moving farther rearward, the operator has to push the grips forward to their original positions without using any strength. To repeatedly pull and push the grips 36 until that the operator achieve his exercise purpose. When the operator pulls the grips 36 rearward, his legs are simultaneously stretched out and when the operator pushes the grips 36 back to its original position, his legs are bowed so that the seat 372 is sliding about on the beam 31 and the legs and waist of the operator are simultaneously exercised.

Figure 8:
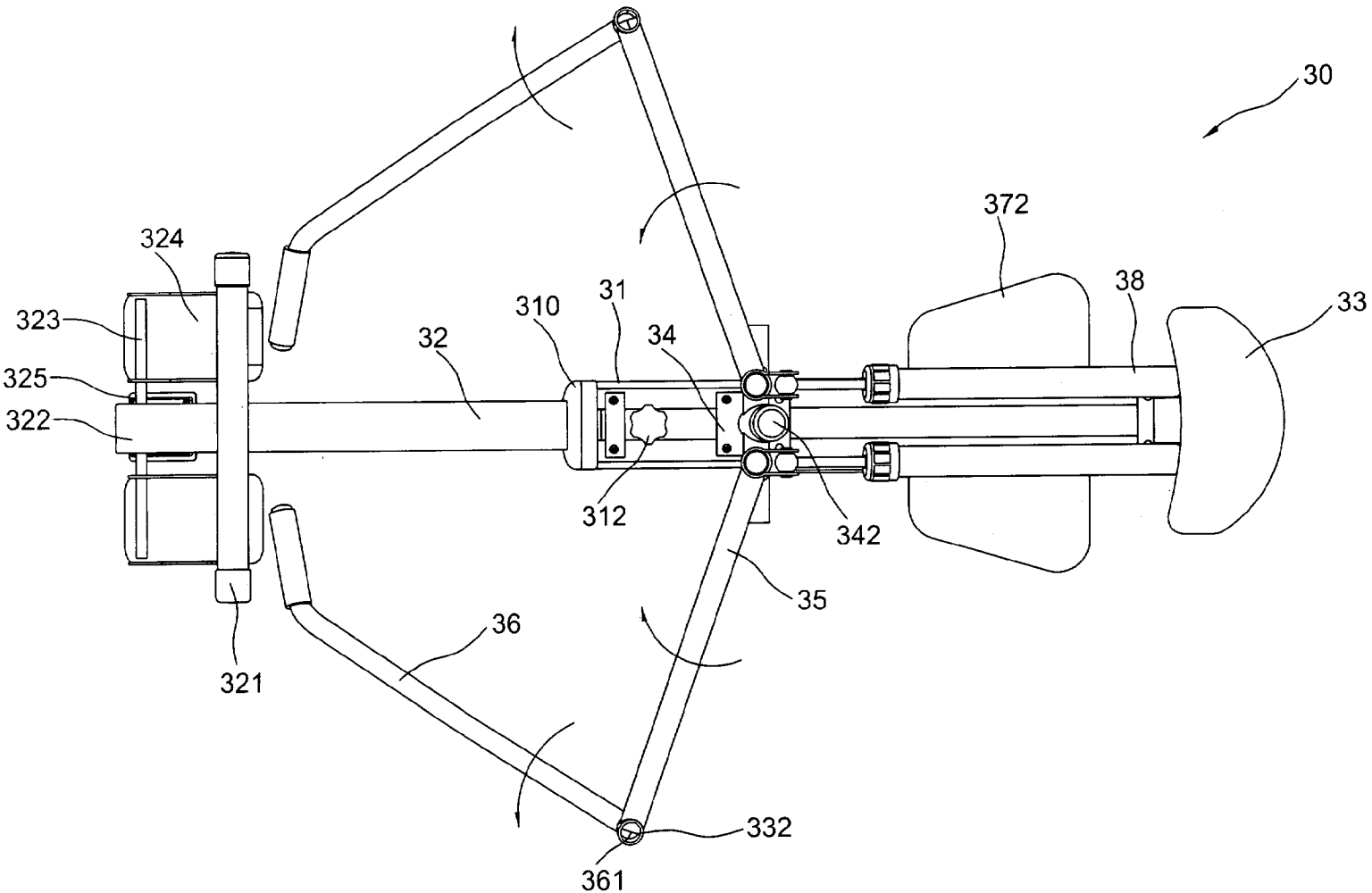
FIG. 8 is an underside view to show the folding process of the oars and grips.
Figure 9:
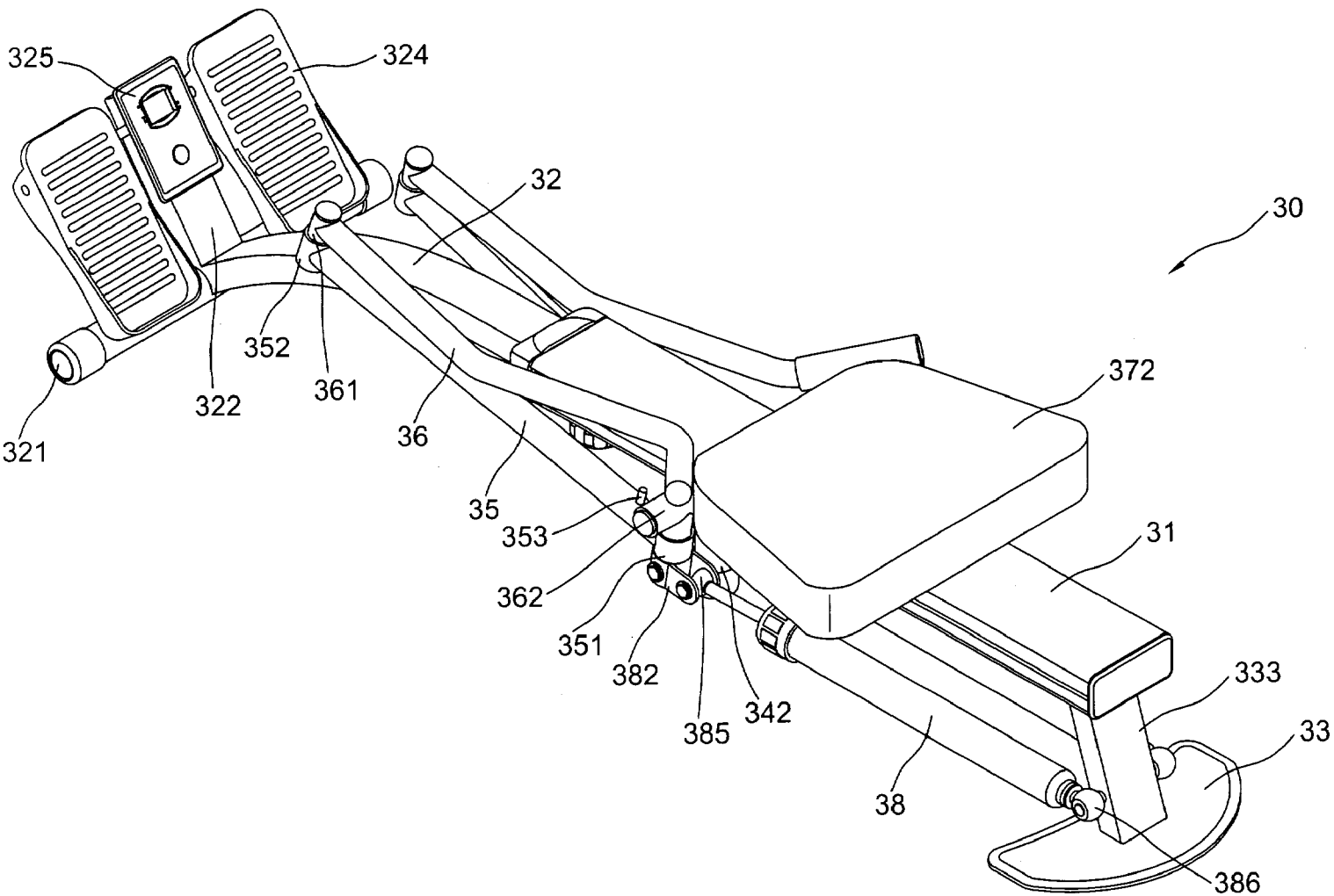
FIG. 9 is a perspective view to show that the oars and grips are already folded up to rely on the beam.

Referring to FIGS. 8 and 9, when folding, move the oars 35 inward to rely on the beam 31 at first, then rotates the grips 36 outward on the vertical axial rods 361 (as shown by the arrows). Which will be superimposed on the top of the oars 35 and relied on to the beam 31. Due to the short transverse bar 31, after the folding of the oars 35 and grips 36, the collapsible boat rowing simulator 30 occupies a lesser space than the prior arts and is convenient to pack for transportation.

Figure 10:
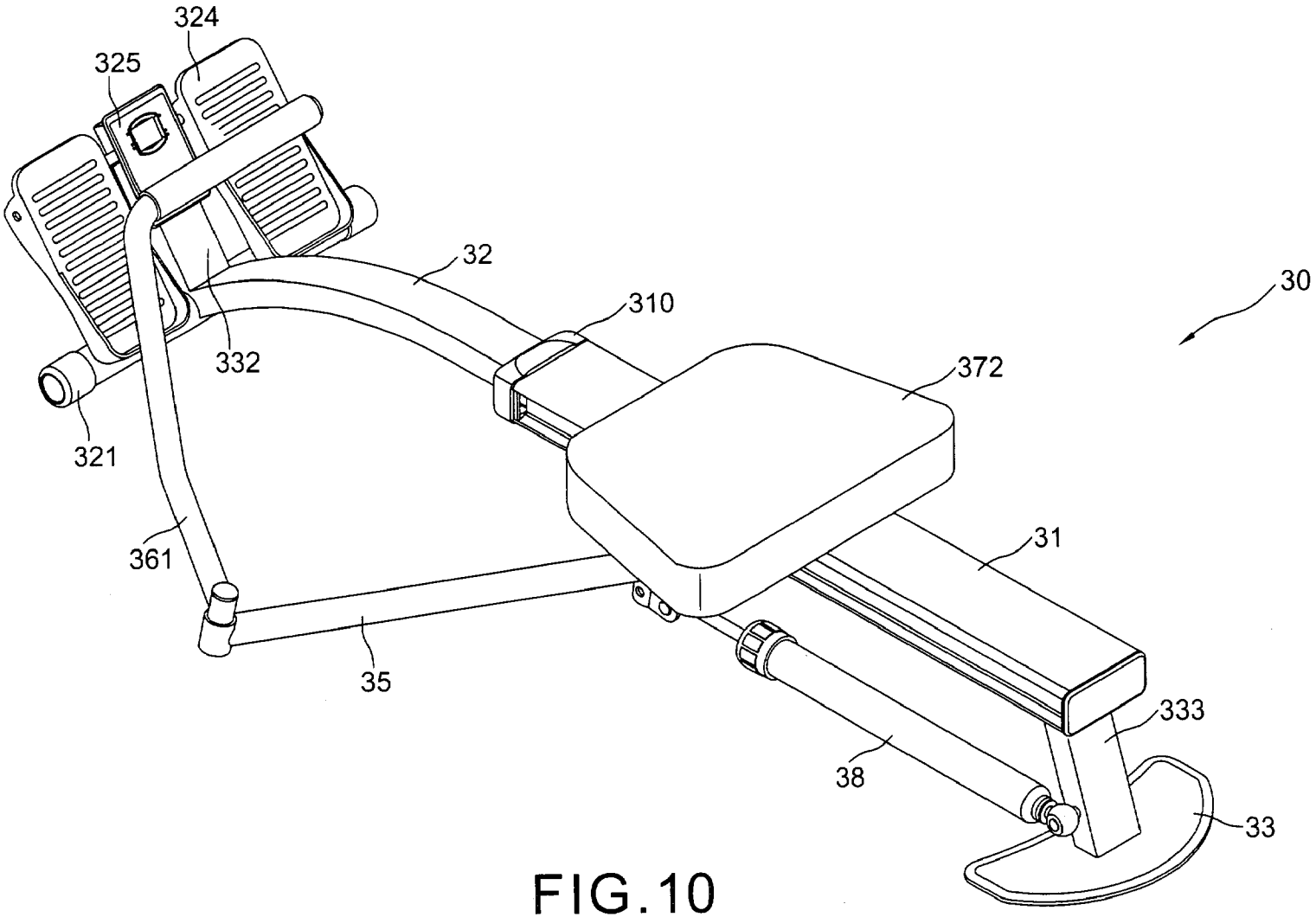
FIG. 10 is a perspective view to show that the oars and grips can be single to serve for handicapped people.

FIG. 10 shows that the oar 35, the grip 36 and the hydraulic cylinder 38 may be single on one side of the beam 31 to be suitable for handicapped people and different condition of the boat. Besides, the transverse portion of the grip 36 may be elongated to facilitate the operator to grasp with two hands.

Figure 11:
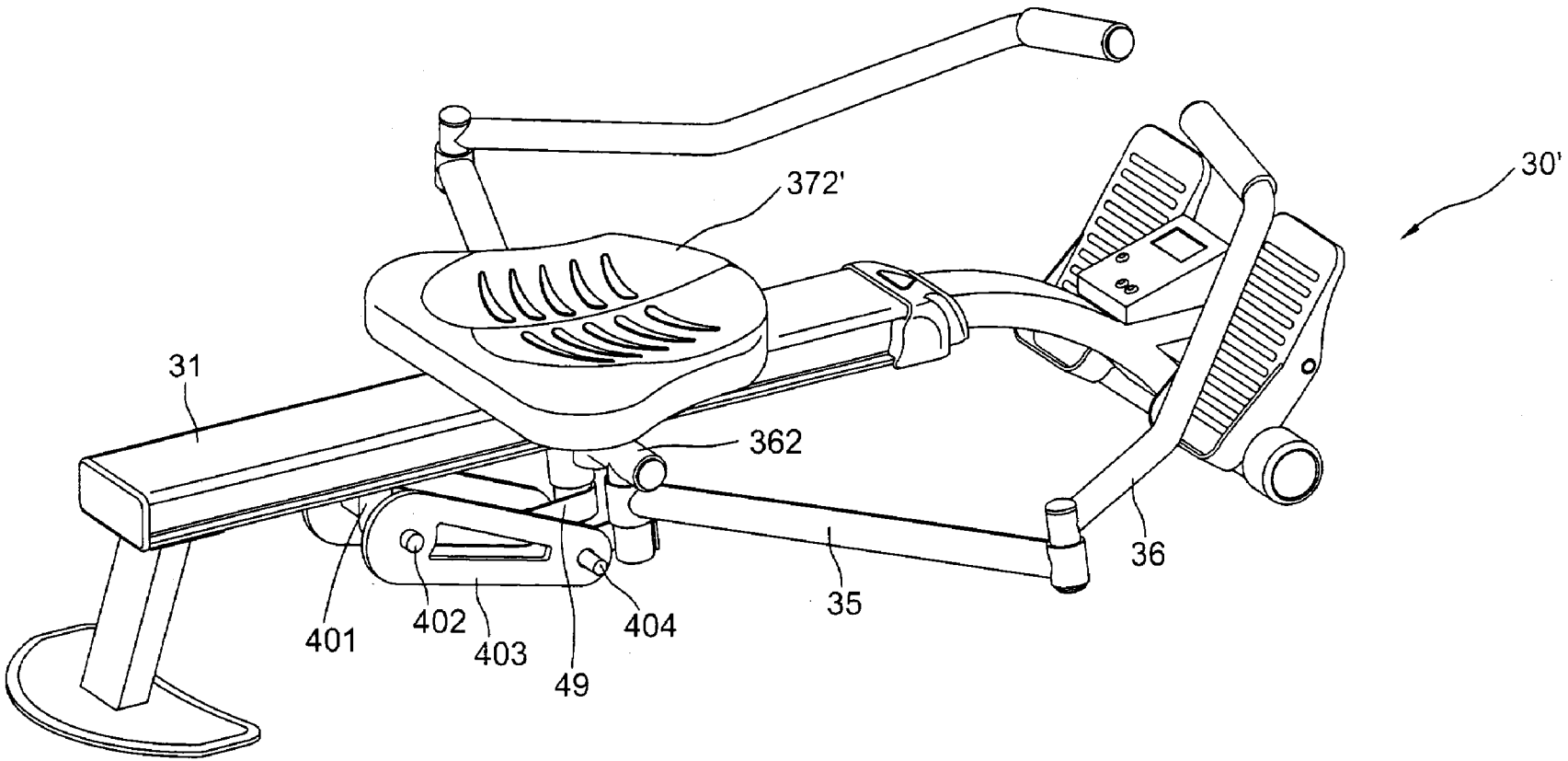
FIG. 11 is a perspective view to show an alternate embodiment of a collapsible boat rowing simulator of the present invention.

Referring to FIG. 11, an alternate embodiment of the collapsible boat rowing simulator 30' is provided. This embodiment is structurally and functionally most similar to the above embodiment and the above discussions is applicable in the most instances. The only difference is that a plurality of the concaved traces added on the upper surface of the seat, and the pair of hydraulic cylinders 38 are removed. Instead of is a cylindrical post 401 centrally projected downward from an underside of the beam 31, a cross rod 402 on the lower portion of the post 401, a pair of oscillating plates 403 having their rear ends respectively secured to two ends of the cross rod 402 and a protrudent rod 404 on two sides of each of the oscillating plates 403 respectively connected to an elastic resistant member 49 which can provide the resistance force and the resilience force to the oars 35 as it did by the hydraulic cylinders 38.

Figure 12:
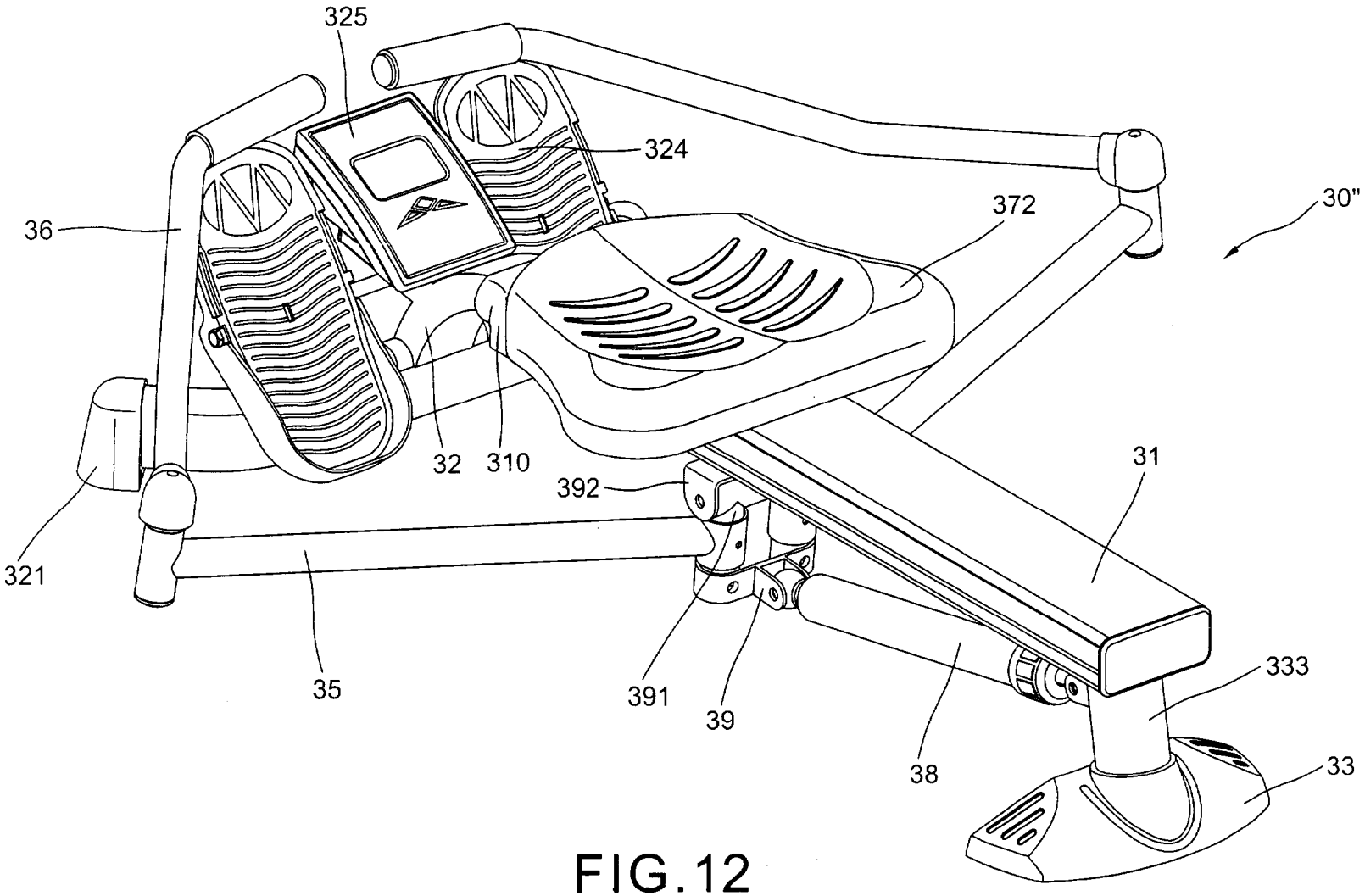
FIG. 12 is perspective view to show another alternate embodiment of the collapsible boat rowing simulator of the present invention.
Figure 13:
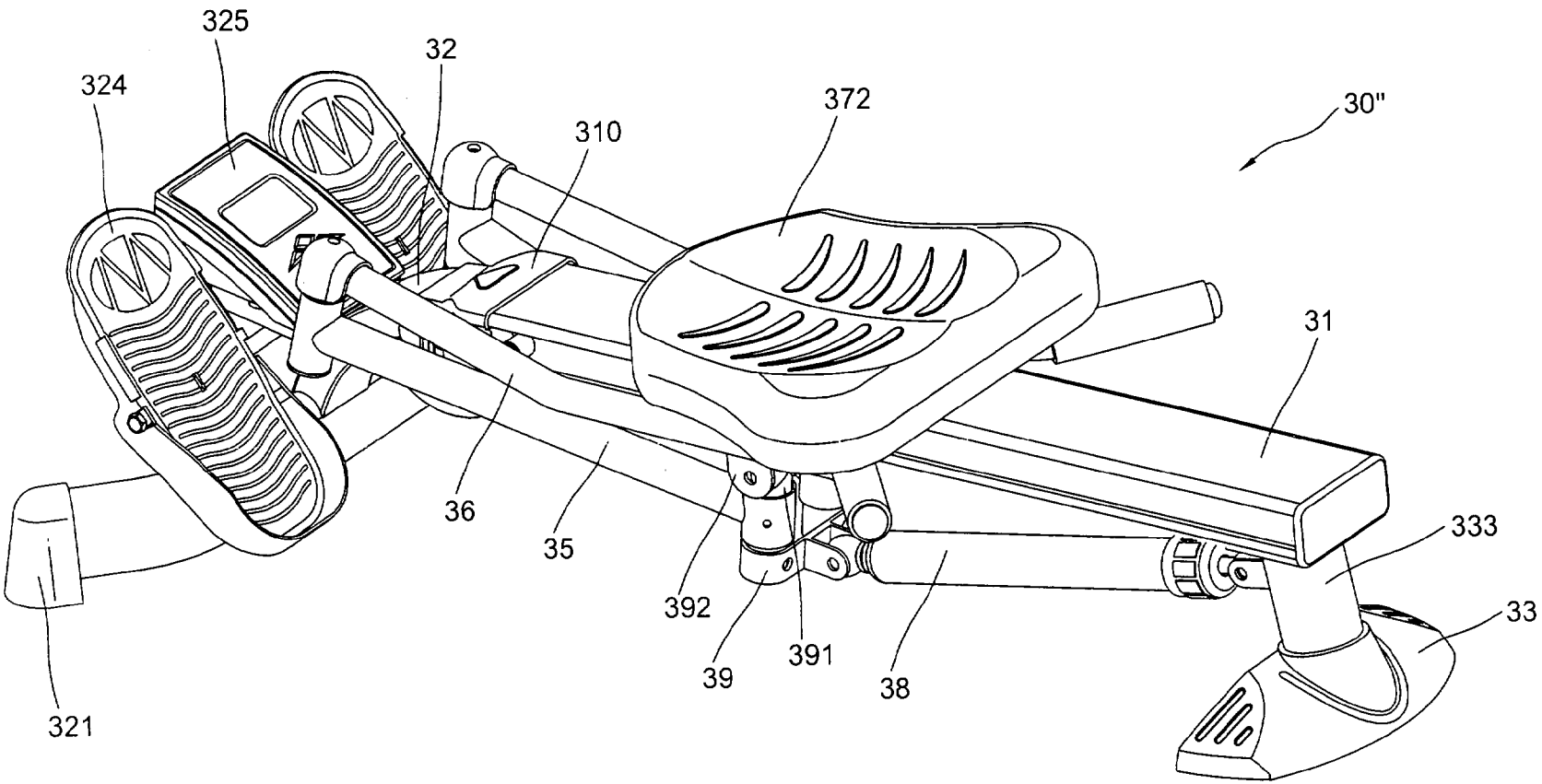
FIG. 13 is a perspective view of FIG. 12 showing that the oars and the grips are folded up to rely on the beam.

Referring to FIGS. 12 and 13, another alternate embodiment of the collapsible boat rowing simulator 30" is provided. This embodiment is structurally and functionally most similar to the above alternate embodiment. The only modification is that the cylindrical post 401, the cross rod 402, the oscillating plates 403 and the elastic resistant member 49 are removed. Instead of is an inverse U-shaped member 392 secured to an underside of the beam 31, a pair of downward projected rods rotatably secured to the under side of the U-shaped member 392 for respectively and fixedly wrapping the vertical tubes 351 of the oars 35, a hoop secured to the lower end of the downward projected rods, a lug centrally projected rearward from the hoop for pivoting the front end of a single hydraulic cylinder 38 which has a rear end pivoted to another lug on the front periphery of the slant post 333.

Upon this modification, the single hydraulic cylinder can serves the two oars 35.

The collapsible boat rowing simulator of the present invention has at the advantages set forth as follows:

a) the T-shaped tube 362 provides a horizontal rotation and the axial rod 361 of the grips 36 provides a vertical slant rotation that causes the movement of the grips 36 more nimble, b) the short transverse rod 321 of the front support 32 is narrowed the wide of the simulator, c) the oars 35 can be folded up to rely on the beam 31 and the grips 36 can be folded up to superimpose on the oars 35 so as to save a great space, and d) the reduced volume of the simulator provides great convenience to pack for transportation, if the front support 32 is removed from the beam 31, it can reduce the length of the simulator.

Note that the specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A collapsible boat rowing simulator comprising:

a beam having a guide in each of lateral sides longitudinally extended along the length thereof;

a T-shaped front support having a transverse bar standing on the ground, an arcuate portion connected to front end of said beam through a sleeve and secured by a shoulder bolt and screws, a slant plate centrally projected upward from front end of said T-shaped front support for disposing a counter thereon, a first cross rod on an upper portion of the slant plate for respectively disposing a pair of tread plates;

a rear support having a semi-circular plate standing on the ground, a slant post centrally projected upward, a second cross rod on lower portion of the slant post and a first rectangular plate on top of the slant post for securing said rear support onto an underside of said beam abutting rear end thereof by screws;

a middle support having a vertical post, a third cross rod on an upper portion of said vertical post and a second rectangular plate on top of said vertical post for securing said middle support onto a middle underside of said beam by screws;

a pair of oars each having a large vertical tube on inner end, a small vertical tube on outer end and a stop rod projected upward from an upper periphery adjacent said large vertical tube thereof;

a pair of T-shaped tubes each having a vertical portion inserted through the large vertical tube of said oars and secured on lower end by an elastic fastener and a screw and a transverse portion respectively and rotatably sleeved on two ends of the third cross rod of said middle support and secured by screws;

a pair of arcuate grips each having a vertical axial rod at inner end rotatably inserted into the small vertical tube of said oars and secured by screws with washers engaged therebetween;

a pair of hydraulic cylinders each having a rear end respectively pivoted to two ends of the second cross rod of said rear support secured by screws with bearings and washers engaged therebetween and a front end pivoted to an opening of said elastic fasteners and secured by screws and nuts;

a U-shaped slider slidably mounted on said beam having four rollers spacedly and rotataly secured to inner side of two lateral walls slidably engaged into the guides of said beam respectively and a seat secured to top of said U-shaped slider by a plurality of screws.

2. The collapsible boat rowing simulator as recited in claim 1 wherein said stop rods are hindered by the transverse portion of said T-shaped tubes.

3. The collapsible boat rowing simulator as recited in claim 1 wherein said oars and said grips are foldable to rely on said beam.

4. The collapsible boat rowing simulator as recited in claim 1 wherein said grips are lengthily adjustable.

5. The collapsible boat rowing simulator as recited in claim 1 wherein said front support is removable.

6. The collapsible boat rowing simulator as recited in claim 1 wherein said oars, said grips and said hydraulic cylinders may be single on side of said beam to serve for handicapped people.

7. A collapsible boat rowing simulator comprising:

a beam having a guide in each of lateral sides longitudinally extended along the length thereof;

a T-shaped front support having a transverse bar standing on the ground, an arcuate portion connected to front end of said beam through a sleeve and secured by a shoulder bolt and screws, a slant plate centrally projected upward from front end of said T-shaped front support for disposing a counter thereon, a first cross rod on an upper portion of the slant plate for respectively disposing a pair of tread plates;

a rear support having a semi-circular plate standing on the ground, a slant post centrally projected upward, and a first rectangular plate on top of the slant post for securing said rear support onto an underside of said beam abutting rear end thereof by screws;

a middle support having a vertical post, a second cross rod on an upper portion of said vertical post and a second rectangular plate on top of said vertical post for securing said middle support onto a middle underside of said beam by screws;

a pair of oars each having a large vertical tube on inner end, a small vertical tube on outer end, a stop rod projected upward from an upper periphery adjacent said large vertical tube thereof;

a pair of T-shaped tubes each having a vertical portion inserted through the large vertical tube of said oars and secured on lower end by an elastic fastener and a screw and a transverse portion respectively and rotatably sleeved on two ends of the second crossed rod of said middle support and secured by screws;

a pair of arcuate grips each having a vertical axial rod at inner end rotatably inserted into the small vertical tube of said oars and secured by screws with washers engaged therebetween;

a cylindrical post centrally projected downward from an underside of said beam including a third crossed rod on lower portion, a pair of oscillating plates each having a rear end respectively secured to two ends of said third crossed rod a protrudent rod on their two sides respectively connected to an elastic resistant member;

a U-shaped slider slidably mounted on said beam having four rollers spacedly and rotatably secured to inner side of two lateral walls engaged into the guides of said beam respectively and a seat secured to top of said U-shaped slider by a plurality of screws and having a plurality of concaved traces on upper surface.

8. A collapsible boat rowing simulator comprising:

a beam having a guide in each of lateral sides longitudinally extended along the length thereof;

a T-shaped front support having a transverse bar standing on the ground, an arcuate portion connected to front end of said beam through a sleeve and secured by a shoulder bolt and screws, a slant plate centrally projected upward from front end of said T-shaped front support for disposing a counter thereon, a cross rod on the upper portion of the slant plate for respectively disposing a pair of tread plates;

a rear support having a semi-circular plate standing on the ground, a slant post centrally projected upward and a rectangular plate on top of the slant post for securing said rear support to an underside of said beam abutting rear end thereof by screws;

a pair of oars each having a large vertical tube on inner end and a small vertical tube on outer end thereof;

a pair of arcuate grips each having a vertical axial rod at inner end rotatably inserted into the small vertical tube of said oars and second by screws with washers engaged therebetween;

an inverse U-shaped member secured to an underside of said beam, a pair of downward projected rods rotatably secured to the underside of the U-shaped member for respectively and fixedly wrapping the large vertical tubes of the oars, a hoop secured to the lower end of the downward projected rods, a lug projected rearward from the hoop for pivoting front end of a single hydraulic cylinder which has a rear end pivoted to another lug on front periphery of the slant post;

a U-shaped slider slidably mounted on said beam having four rollers spacedly and rotatably secured to inner sides of two lateral walls slidably engaged into the guides of said beam and a seat secured to top of said U-shaped slider by a plurality of screws and having a plurality of concaved traces on upper surface.

* * * * *